United States Patent [19]

Beach et al.

[11] 4,068,969

[45] Jan. 17, 1978

[54] GUTTER ATTACHMENT FOR ASPHALT SPREADER

[76] Inventors: Roy Beach; Ivan Beach, both of 1708 - 6th Avenue East, Owen Sound, Ontario, Canada

[21] Appl. No.: 801,041

[22] Filed: May 27, 1977

[51] Int. Cl.[2] ..... E01C 11/28

[52] U.S. Cl. ..... 404/98; 404/104; 404/118

[58] Field of Search ..... 404/104, 118, 98

[56] References Cited

U.S. PATENT DOCUMENTS

| | | | |
|---|---|---|---|
| 1,467,243 | 9/1923 | Fitzgerald | 404/98 |
| 1,480,620 | 1/1924 | Latture | 404/104 |
| 3,202,068 | 8/1965 | Larsen | 404/98 |
| 3,377,933 | 4/1968 | Dale | 404/98 |
| 3,415,173 | 12/1968 | Paul | 404/118 |
| 3,543,653 | 12/1970 | Meadows | 404/118 X |
| 3,680,451 | 8/1972 | Birtchet | 404/104 |
| 3,915,583 | 10/1975 | Aparicio | 404/98 |

*Primary Examiner*—Nile C. Byers
*Attorney, Agent, or Firm*—W. Charles Kent

[57] ABSTRACT

An attachment for one side of an asphalt paving machine to permit laying of a gutter adjacent to and integral with a roadway surface at the same time as the roadway surface is being paved. The device comprises an extension plate to be vertically oriented in alignment with the screed of the asphalt paving machine and means associated with the extension plate to secure it in this position. The extension plate has a rearwardly curved, L-shaped base extending from side to side along the bottom of the plate for smoothing the asphalt. An end gate is provided at the outer end of the attachment to control the spread of asphalt to the required width. The attachment is intended to be bolted to an automatic screed extension or to the side of the screed of the asphalt paving machine, to replace the screed end gate.

12 Claims, 4 Drawing Figures

GUTTER ATTACHMENT FOR ASPHALT SPREADER

BACKGROUND OF THE INVENTION

This invention relates generally to an attachment for an asphalt paving machine and more specifically to an attachment for such a machine which will permit the laying of a gutter adjacent to and integral with a roadway surface which is being simultaneously laid by the machine.

In asphalt paving operations requiring a gutter strip adjacent to and co-extensive with the roadway surface, it is traditional to pave the roadway first and in a separate operation pave the narrow gutter beside it. Such a second operation adds considerably to the expense of the paving operation not only in respect of time taken but also in respect of equipment and energy used.

The gutter forming operation is a fairly precise one since the width and cross-sectional profile of gutters beside highways are carefully controlled by Government regulations. In Ontario, for example, regulations often require that the gutter be 32 inches in width and have a cross-sectional profile such that the half of the gutter nearest the roadway is downwardly sloped, away from the roadway, two inches over its width, and the other half of the gutter is then upwardly sloped from the lowest point of the first half a total of 6 inches over its width. This gives an uneven "V"-shaped cross-sectional profile or contour to the gutter. The first, downward slope is relatively gradual to prevent a driver, who may have accidentally steered a wheel onto the gutter from losing control of the car before he can return that wheel to the normal surface of the roadway. The outer, upward slope of the gutter is steeper to minimize the spillover of water which may be running along the gutter, over the outer edge of the gutter down into the shoulders. When this occurs, erosion of the shoulders results with consequent undermining of the roadbed and damage to the edge surfaces of the roadway.

Many attachments for asphalt spreading machines have been proposed in the prior art for a variety of purposes. Indeed, the automatic screed extension, to which the attachment of the present invention may be attached, is itself an attachment to such machine. North American asphalt paving machines are customarily made for laying ten foot wide strips of asphalt. In order to pave half the width of a 22 foot or 24 foot wide roadway, however, it is necessary to provide for an extension of the strip which the machines can pave. This is done by means of an automatic extension which is secured to and adjustable sideways on the original screed of the paving machine. Using such an extension, it is possible then to pave the required width of one-half the road surface, one-half the road surface normally being paved at one time in an asphalt highway paving project. Such a screed extension is described and illustrated in Canadian Pat. No. 779,653 of J. D. Layton, issued Mar. 5, 1968, this extension being used on a paver to be towed behind a dump truck. Curb and gutter paving machines, of general background interest, are described and illustrated in Canadian Pat. Nos. 502,483 of E. S. Clark, et al., issued May 18, 1954; Canadian Pat. No. 596,171 of W. E. Canfield, et al., issued Apr. 12, 1960 and Canadian Pat. No. 768,408 of J. Sigmund, issued Oct. 3, 1968.

U.S. Pat. No. 3,680,451 of R. D. Birtchet, issued Aug. 1, 1972 describes a pivotable wing attachment for an automatic screed extension which enables either, but not a combination of, upward or downward sloping of a margin of the roadway during paving. The wing is made up of an elongated blade having a substantially straight and horizontal lower edge and a second, shorter elongated blade extending parallel to the first blade but cut at an angle so that the departure point of the sloping portion relative to the horizontal portion of the roadway remains the same when the angle of the main blade is changed. The Birtchet device however is not intended to be an attachment for forming a gutter beside a roadway and indeed would be unable to operate as such since, if it were modified to provide both downward and upward slopes to form an appropriate gutter, the device would be unable to provide a sufficient slope to the outside portion of the gutter, i.e. the backing, to satisfy Government requirements. The reason for this is that the screed backing, in order to provide adequate support for the device, must be so low that only a very limited upward angle could be achieved. In addition, such attachment is not readily movable since the pivot bolt, being positioned so close to the asphalt being spread, would become extremely hot and difficult to work during the paving operation.

It is an object of the present invention to provide an attachment for an asphalt machine which may be readily attached or detached therefrom, which will enable laying of a gutter simultaneously with the laying of the roadway surface. It is a further object of the invention to provide an attachment which will enable laying of a gutter integral with a roadway surface and having a cross-sectional profile complying with Government standards and regulations.

SUMMARY OF THE INVENTION

In accordance with the invention such an attachment is provided for one side of an asphalt paving machine, which machine is provided with a draw arm, screw auger and screed, to permit laying of a gutter adjacent to and integral with a roadway surface which is simultaneously laid. The attachment comprises a flat extension plate for vertical orientation, the plate having opposite sides and a top and bottom, with appropriate supports secured at each side. Means are associated with the extension plate to easily and releasably secure it in this vertical orientation, parallel to and aligned with the screed. A rearwardly curved base extends from side to side along the bottom of the plate, for example in the shape of a wide "V", to conform to the desired cross-sectional profile shape of the gutter, the attachment being attachable to the asphalt paving machine so that the bottom portion of the base nearest the screed when the attachment is in position on the machine is more or less flush with the proximate portion of the bottom of the screed, and so that the apex of the "V" of the base is substantially below the bottom of the screed.

It is preferred that the base of the extension plate be of uneven "V" shape and, in one construction which would form a gutter according to acceptable Government standards, would have a downward slope of about two inches, over a sixteen inch width of the plate, to a point away from the side securable to the asphalt paving machine, and an upward slope of about 6 inches, over a 16 inch width, continuing from that point in that same direction. By providing angle iron supports at each side of the extension plate, with the support to be secured to the asphalt paving machine having appropriately positioned cut-away channels for receiving bolts, a readily attachable or detachable gutter paving device is provided. Preferably the bolts to secure the extension plate to the asphalt paving machine are the same bolts which normally secure the paving machine end gate on the one side of the machine, that end gate being removed or rotated out of the way when the attachment in question is used.

In operation on the machine, it may be desirable to have a screw auger extension to ensure spreading of asphalt into the region in front of the attachment and within the attachment end gate. A roller of appropriate contour, dragged behind the asphalt paving machine in alignment with the attachment can simultaneously provide the appropriate rolling of the asphalt gutter.

It will be understood that because of the simple means of attachment of this device to the asphalt paving machine, the device may be made so that it can be appropriately attached to virtually any make of asphalt paving machine, with little or no machining or alteration of the structure of the machine. Of course, depending upon which side of the machine the attachment is to be secured, a "left hand" or "right hand" attachment is provided.

BRIEF DESCRIPTION OF THE DRAWINGS

Other objects and advantages of the invention will become apparent upon reading the following detailed description and upon referring to the drawings in which.

In the drawings similar features have been given similar reference numerals.

While the invention will be described in connection with an example embodiments, it will be understood that it is not intended to limit the invention to these embodiments. On the contrary it is intended to cover all alternatives, modifications and equivalents as may be included within the spirit and scope of the invention as defined by the appended claims.

DETAILED DESCRIPTION OF THE INVENTION

Figure 1:
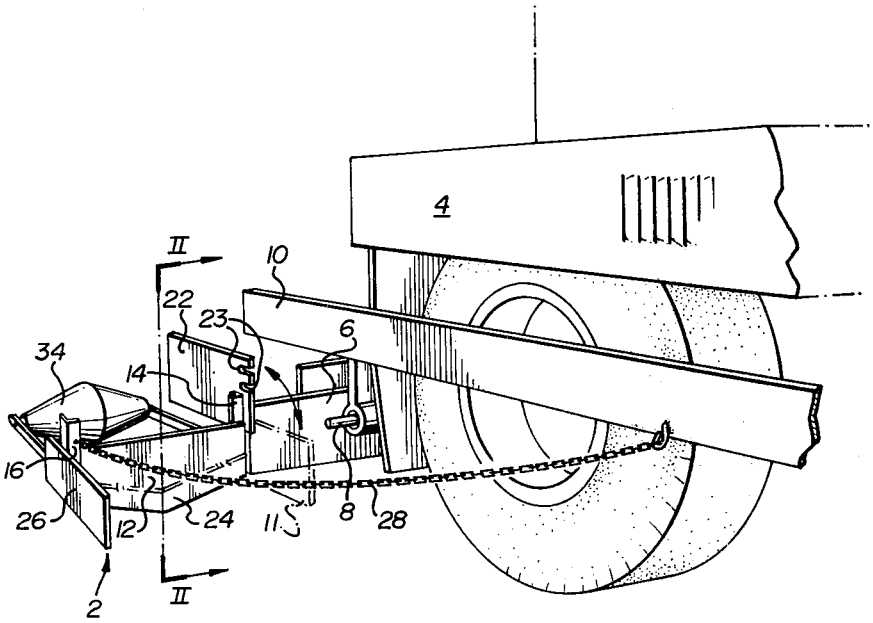
FIG. 1 is a perspective view of the right rear side portion of an asphalt paving machine to which has been secured an attachment according to the present invention.

Turning first to FIG. 1, there is shown an attachment 2 according to the present invention secured to the right side of an asphalt paving machine 4, the machine having screed 6, screw auger 8 and draw arm 10 as parts thereof.

Figure 2:
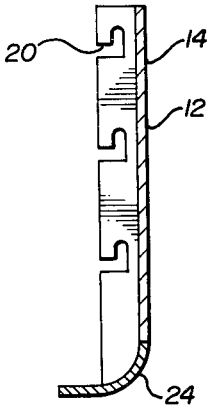
FIG. 2 is a sectional view of the attachment along line II—II in FIG. 1.

Attachment 2 has extension plate 12 which is vertically aligned adjacent to screed 6. To the sides of extension plate 12 are secured vertical angle irons 14 and 16. Bolts 18 and nuts 19 (FIGS. 3, 4) secure angle iron 14 and attachment 2 to paving machine 4. Cut-outs 20, as can be seen in FIG. 2, are appropriate positioned in angle iron 14 to receive the stems of bolts 18 so that the bolts used to secure the end gate 22 of screed 6 (or the automatic screed extension where one is used) can be used. In such instance, endgate 22 of the screed 6 is either removed (FIGS. 3 and 4) or, as in FIG. 1, by the use of appropriate cut-outs 23 in the end gate, that gate is pivoted out of the way when installing attachment 2.

Extending along the bottom of plate 12, from side to side is base 24, rearwardly curved as can be seen in FIG. 2. The base has a "V" shape, when viewed from front or back, formed to give the desired shape of the gutter. The bottom portion of the base nearest the screed, when the attachment is secured in position on the machine is more or less flush with the bottom of screed 6, as seen in FIG. 3.

Figure 3:
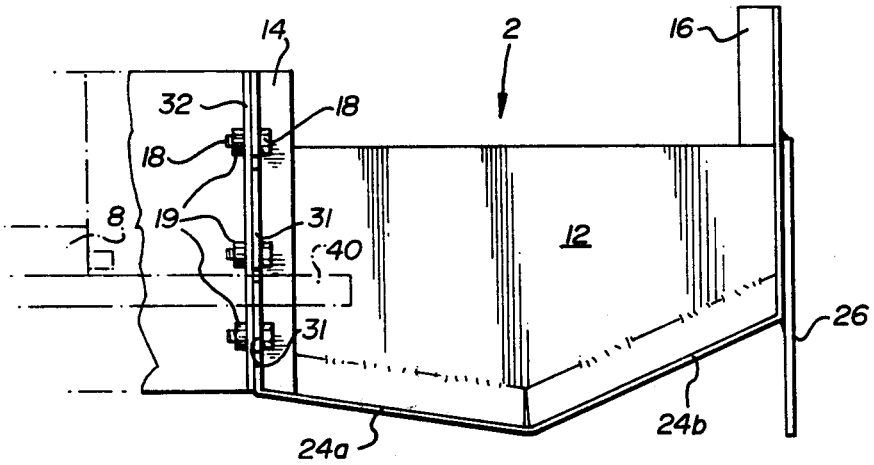
FIG. 3 is a front view of an attachment according to FIG. 1, but intended for attachment to the other side of the paving machine.

Turning to FIG. 3, the extension plate illustrated is designed to provide a gutter to satisfy Government regulations for example requiring a gutter thirty-two inches wide, with a first base section 24*a* downwardly sloped two inches over half this width, and a second half section 24*b* rising six inches to form the gutter backing and prevent water from spilling over the edge of the gutter onto the shoulder of the road and causing erosion. End gate 26 is secured to angle iron 16 to ensure spreading of asphalt to the required width in laying the gutter, and preferably extends below the adjacent portion of the base 24 at least a sufficient distance to ensure proper depth of asphalt formed on the corresponding outer shoulder of the gutter. In the extension plate of these dimensions gate 26 may be a flat plate of steel approximately three-eighth inches thick, thirty-two inches long and fourteen inches wide, bolted onto angle iron 16 so that approximately 20 inches of this plate extends in front of extension plate 12 to control the width of asphalt laid, and 6 inches of this end gate 26 extends below the portion of base 24 adjacent thereto.

Chain 28 provides additional support to the attachment 2 as it is pulled along the side machine 4, extending between draw arm 10 and angle iron 16.

Figure 4:
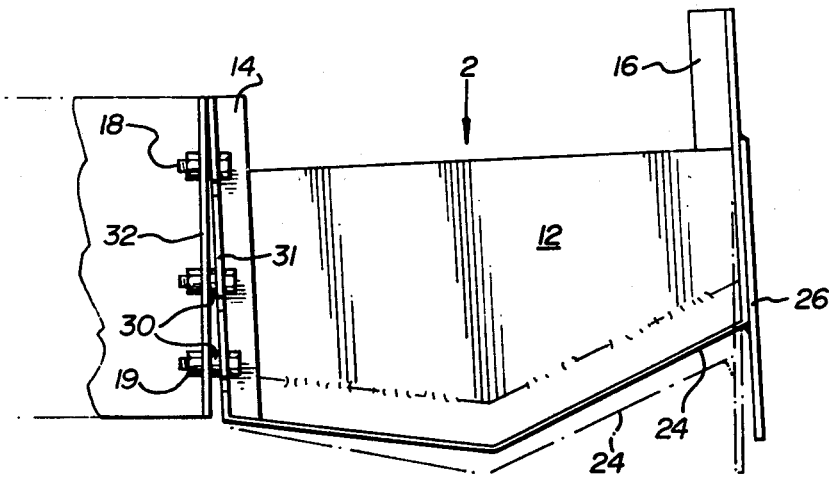
FIG. 4 is a front view of the attachment of FIG. 3 having additionally spacers which permit minor adjustment of the orientation of the attachment in position on the asphalt paving machine.

As illustrated in FIG. 4, a spacer 30 may be inserted on bolt 18 between angle iron 14 and support 32 on the machine to incline the plate. This permits limited alteration of the height of the outside edge of the gutter and of the slope of the surfaces of the gutter formed by the device. For instance, a three-eighth inch lower spacer would elevate the outer shoulder of the gutter to seven to 8 inches from six based on the dimensions referred to.

As shown in FIG. 1, a gutter roller 34 of appropriate profile may be dragged behind the attachment to roll the gutter once the asphalt has been laid in the appropriate amount and form.

To remove the gutter attachment, once a paving operation is ended or when a gutter is not required, all that need be done is to loosen bolts 18 and nuts 19 on angle iron 14, slide attachment 2 off of the bolts, swing screed end gate 11 back into position, (or where it was completely removed, replace it) and tighten bolts 18. This can be carried out in a very few minutes.

If necessary, extension 40 (seen in chain line in FIG. 3) may be added to the end of screw auger 8 to ensure proper delivery of asphalt material in front of extension plate 12 for paving.

It will be noted, from FIG. 2, that base 24 is L-shaped and rounded at the bend in the "L". This enables smooth spreading and laying of the asphalt gutter. Of course, since the asphalt for the road surface and for the gutter is spread and paved at the one time, the asphalt gutter is integrally bound with the roadway.

Thus there has been provided in accordance with the invention an attachment for an asphalt paving machine for laying a gutter that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly it is intended to embrace all such alternatives, modifications and variations as fall within the spirit and broad scope of the appended claims.

I claim as my invention:

1. An attachment for one side of an asphalt paving machine, the paving machine having draw arms, a screw auger and a screed, to permit the laying of a gutter adjacent to and integral with a roadway surface being simultaneously laid, the attachment comprising:

a. a flat extension plate for vertical orientation, the plate having top and bottom and opposite sides, and supports secured to each side thereof;

b. means associated with one of the supports to releasably secure the plate in vertical orientation parallel to and aligned with the screed;

c. a rearwardly curved base secured to and extending from side to side along the bottom of the extension plate to conform to the desired cross-sectional profile shape of the gutter, the bottom of the portion of the base nearest the screed, when the attachment is secured in position to the machine, being more or less flush with the bottom of the screed;

d. an end gate secured to the outer support to ensure proper width and edging of asphalt gutter.

2. An attachment according to claim 1, wherein the base is in the shape of a wide "V", and the apex of this "V" is substantially below the bottom of the screed when the attachment is secured in position to the machine.

3. An attachment according to claim 2, wherein the extension plate is about thirty-two inches from side to side, and, with the extension plate in vertical orientation to be secured to the paving machine, the base slopes downwardly about 2 inches over about half the width of the plate, and extends upwardly about 6 inches over the remaining half, of the width of the plate to the outer support.

4. An attachment according to claim 2, wherein the slope of the half of the base to be farthest from the machine is about 2 to 3 times as great as the slope of the half of the base to be nearest the machine.

5. An attachment according to claim 4, wherein said supports comprise vertical angle irons secured to each side of the extension plate.

6. An attachment according to claim 5, wherein bolt means are provided to secure one of the angle irons to a co-operating support means secured to one side of the paving machine.

7. An attachment according to claim 6, further comprising spacer means associated with the bolt means and positioned between the angle iron and the paving machine support means whereby the height of the outside edge of the gutter formed by the machine and the inclination of the surfaces of the gutter formed by the attachment may be altered.

8. An attachment according to claim 1, further comprising a chain to be secured to and extend from the extension plate to the side of the adjacent draw arm of the paving machine, in advance of the attachment, to provide further support for the attachment.

9. An attachment according to claim 2, wherein the end gate is made of steel approximately $\frac{3}{8}$ inches thick by 32 inches long by 14 inches wide and is secured to the outer support of the attachment so that approximately 20 inches of the end plate extends forwardly of the extension plate, the end plate extending downwardly below the bottom corner of the base proximate thereto by about 6 inches.

10. An attachment according to claim 1, wherein the base consists of an L-shaped flange secured to the bottom of the extension plate, the front surface of the bend of the flange being rounded to prevent buildup of asphalt in front thereof during the paving operation.

11. The combination of an attachment according to claim 1, and a paving machine having a draw arm, screw auger and screed, the paving machine being provided with spreader means to ensure that adequate quantities of asphalt are delivered to the area between the paving machine and the end plate of the attachment for simultaneous paving of the gutter of the roadway.

12. The combination according to claim 11, further comprising a roller of a contour corresponding to that of the base of the extension plate, pulled, by appropriate support means, in a line behind the attachment, for rolling the gutter.

* * * * *